US010267339B2

(12) United States Patent
Sun et al.

(10) Patent No.: US 10,267,339 B2
(45) Date of Patent: Apr. 23, 2019

(54) SERIES FAN STRUCTURE

(71) Applicant: ASIA VITAL COMPONENTS CO., LTD., New Taipei (TW)

(72) Inventors: Sung-Wei Sun, New Taipei (TW); Feng Liu, New Taipei (TW); Ze-Hua Tan, New Taipei (TW); Jing-Ping Huang, New Taipei (TW)

(73) Assignee: ASIA VITAL COMPONENTS CO., LTD., New Taipei (TW)

( * ) Notice: Subject to any disclaimer, the term of this patent is extended or adjusted under 35 U.S.C. 154(b) by 169 days.

(21) Appl. No.: 15/287,741

(22) Filed: Oct. 7, 2016

(65) Prior Publication Data

US 2018/0100518 A1 Apr. 12, 2018

(51) Int. Cl.

| | |
|---|---|
| ***F01D 19/00*** | (2006.01) |
| ***F04D 29/66*** | (2006.01) |
| ***F04D 19/00*** | (2006.01) |
| ***F04D 29/54*** | (2006.01) |

(52) U.S. Cl.

CPC ..... *F04D 29/667* (2013.01); *F04D 19/007* (2013.01); *F04D 29/541* (2013.01)

(58) Field of Classification Search

CPC .... F04D 29/667; F04D 19/007; F04D 29/325; F04D 29/541

See application file for complete search history.

(56) References Cited

U.S. PATENT DOCUMENTS

| | | | | |
|---|---|---|---|---|
| 3,144,201 A * | 8/1964 | Rundle | F04D 29/324 415/194 |
| 2009/0290984 A1* | 11/2009 | Miyabara | F04D 19/007 416/198 R |
| 2013/0126698 A1* | 5/2013 | Yin | G06F 1/20 248/674 |
| 2015/0086351 A1* | 3/2015 | Chang | F04D 19/002 415/213.1 |

* cited by examiner

*Primary Examiner* — Justin Seabe
*Assistant Examiner* — Behnoush Haghighian
(74) *Attorney, Agent, or Firm* — Jackson IPG PLLC; Demian K. Jackson

(57) ABSTRACT

A series fan structure includes a series fan assembly and an assembling member. The series fan assembly has a first fan and a second fan. The first and second fans are correspondingly serially connected with each other. The first fan has a first fan frame defining a first receiving space. The second fan has a second fan frame defining a second receiving space. The assembling member is disposed between the first and second fan frames. The assembling member is formed with multiple straight-through perforations in communication with the first and second receiving spaces. The series fan structure improves the vibration and noise problem of the conventional series fan structure and is able to increase airflow volume.

10 Claims, 7 Drawing Sheets

SERIES FAN STRUCTURE

BACKGROUND OF THE INVENTION

1. Field of the Invention

The present invention relates generally to a series fan structure, and more particularly to a series fan structure, which greatly improves the vibration problem of the conventional series fan structure and greatly reduces the noise caused by the vibration. Also, the series fan structure is able to increase airflow volume.

2. Description of the Related Art

Along with the continuous advance of science and technologies, the dependence of peoples on various electronic apparatuses has more and more increased. In operation, the internal components of the electronic products (such as computers and notebooks) will generate high heat. The heat generated by the internal components must be conducted outside the electronic product in time. Otherwise, the electronic product will overheat. In general, a fan is disposed in the electronic product to dissipate the heat and keep the electronic product operating at an operation temperature within a certain range.

Please refer to FIG. 1. A conventional series fan 1 has same fan frames 10 with the same size. The fan frames 10 are assembled with fan impellers 11, motors (not shown) and other components to form the series fan 1. In operation, due to the design principle of motor torque operation, the series fan 1 will inevitably vibrate, especially the series fan composed of more than two fans, which are serially connected with each other. In the conventional series fan structure, the fan frames 10 have latch structures or screw locking structures 12 for simply serially connecting the fan frames 10. Such serial connection is achieved along the central shaft of the fan so that the vibration state cannot be changed. When the fan impellers 11 in the fan frames 10 simultaneously rotate and operate, under the inter-affection of the ground-state vibration frequency of the fan impellers 11, the fan frames 10 will have severe co-vibration effect. Due to the co-vibration effect, the series fan will make loud noise. Moreover, the fan frames of the conventional series fan are directly serially connected. Therefore, when the conventional series fan operates, the air volume taken in by the fan can be hardly fully discharged from the other fan. (That is, the air volume will partially miss when transferred from one fan to the other). As a result, the conventional series fan has smaller airflow volume.

According to the above, the conventional series fan has the following shortcomings:

1. The vibration of the fan cannot be effectively reduced.
2. Due to the co-vibration effect, the series fan will make loud noise.
3. The conventional series fan has smaller airflow volume.

It is therefore tried by the applicant to provide a series fan structure, which can solve the above problems and shortcomings of the conventional series fan.

SUMMARY OF THE INVENTION

It is therefore a primary object of the present invention to provide a series fan structure, which can greatly improve the vibration problem of the conventional series fan so as to reduce the noise caused by the vibration.

It is a further object of the present invention to provide the above series fan structure, which is able to increase airflow volume.

To achieve the above and other objects, the series fan structure of the present invention includes a series fan assembly and an assembling member. The series fan assembly has a first fan and a second fan. The first and second fans are correspondingly serially connected with each other. The first fan has a first fan frame defining a first receiving space. A first dynamic impeller is received in the first receiving space. The second fan has a second fan frame defining a second receiving space. A second dynamic impeller is received in the second receiving space. The assembling member is disposed between the first and second fan frames. The assembling member is formed with multiple perforations in communication with the first and second receiving spaces.

According to the structural design of the series fan structure, the assembling member with multiple perforations is assembled between the first and second fan frames. This can greatly improve the vibration problem of the conventional series fan and greatly reduces the noise caused by the vibration. Moreover, the series fan structure is able to greatly increase airflow volume.

BRIEF DESCRIPTION OF THE DRAWINGS

The structure and the technical means adopted by the present invention to achieve the above and other objects can be best understood by referring to the following detailed description of the preferred embodiments and the accompanying drawings, wherein.

DETAILED DESCRIPTION OF THE PREFERRED EMBODIMENTS

Figure 1:
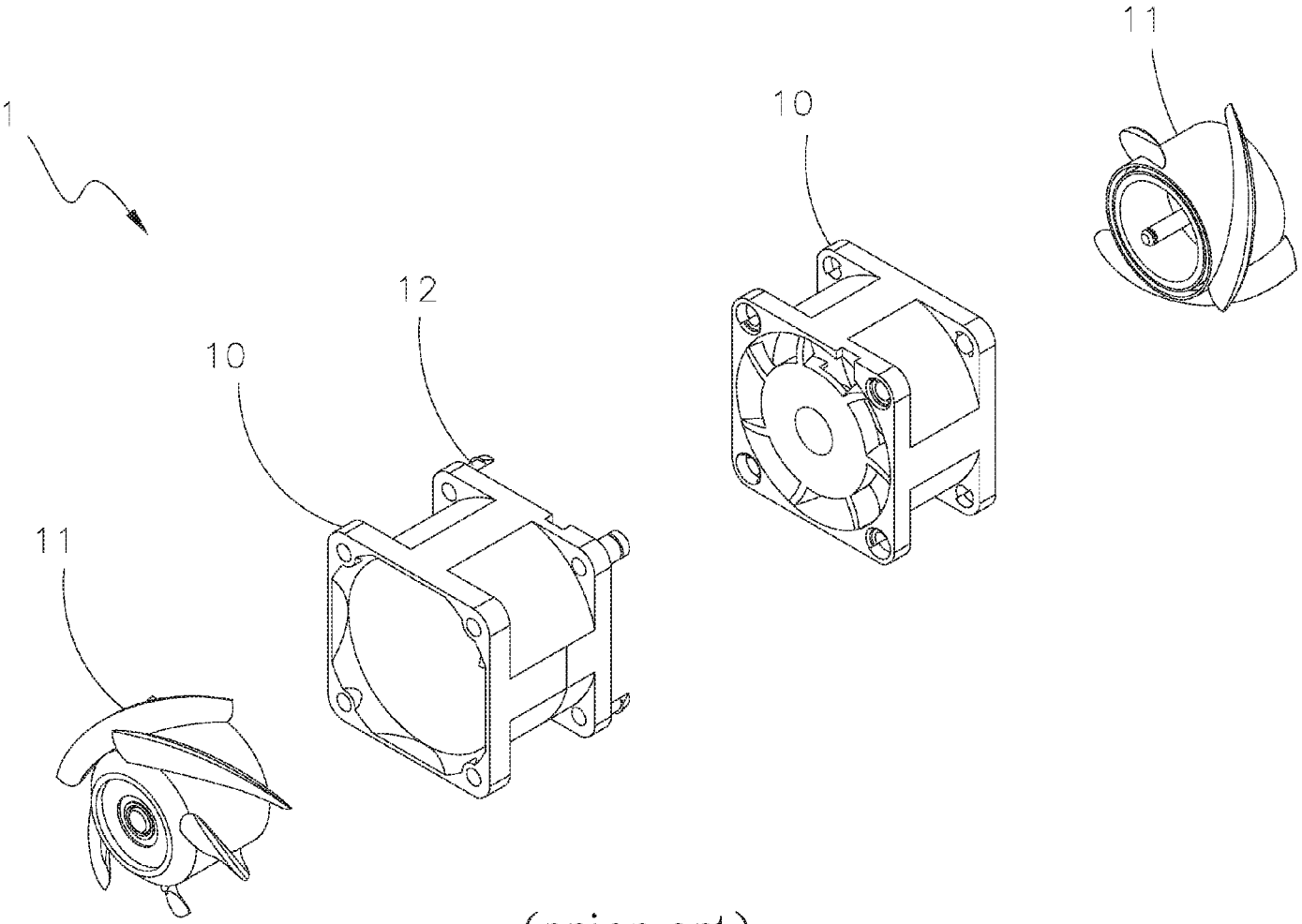
(prior art) Fig. 1
FIG. 1 is a perspective exploded view of a conventional series fan structure.
Figure 2:
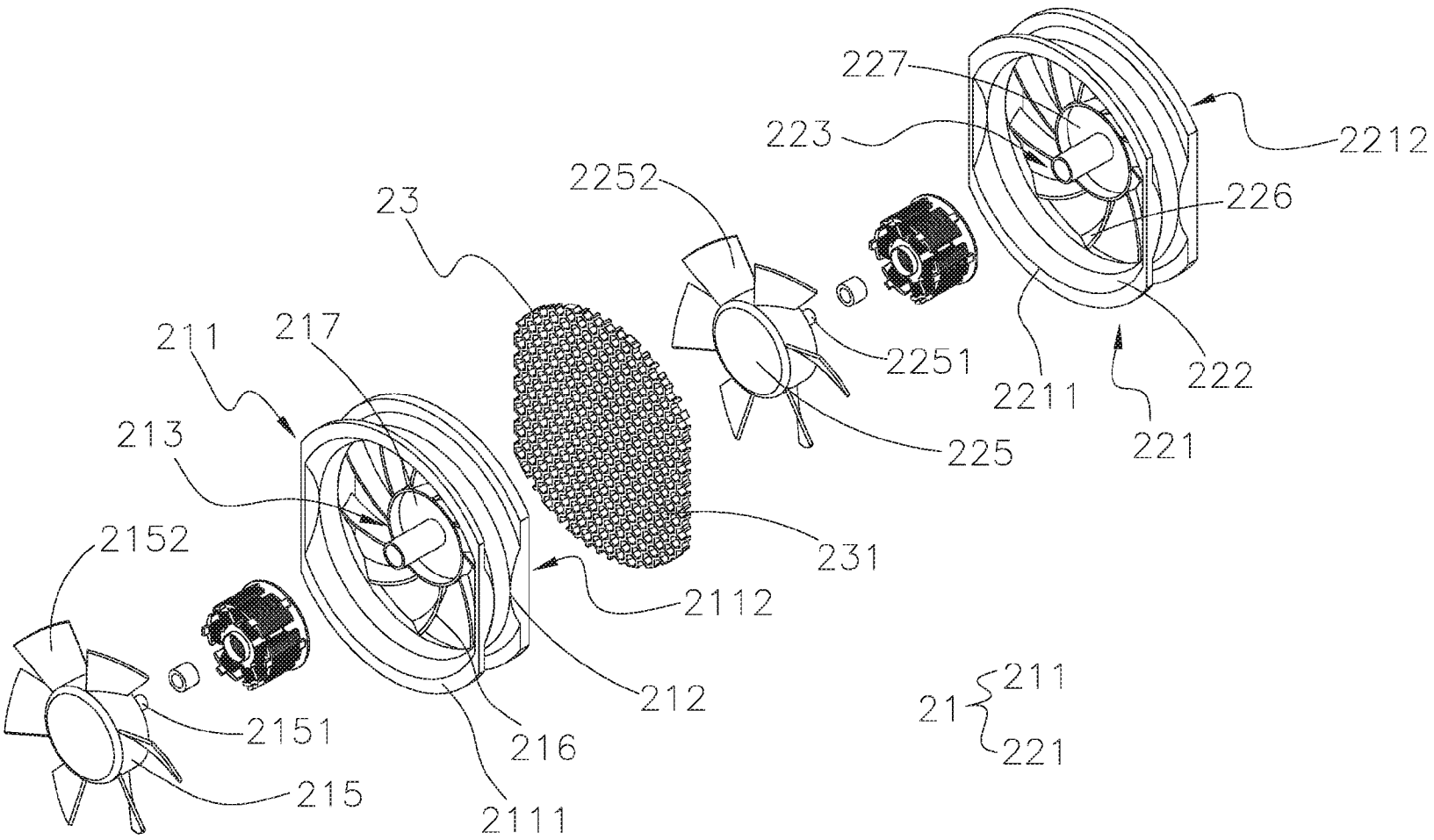
FIG. 2 is a perspective exploded view of a first embodiment of the series fan structure of the present invention.
Figure 3:
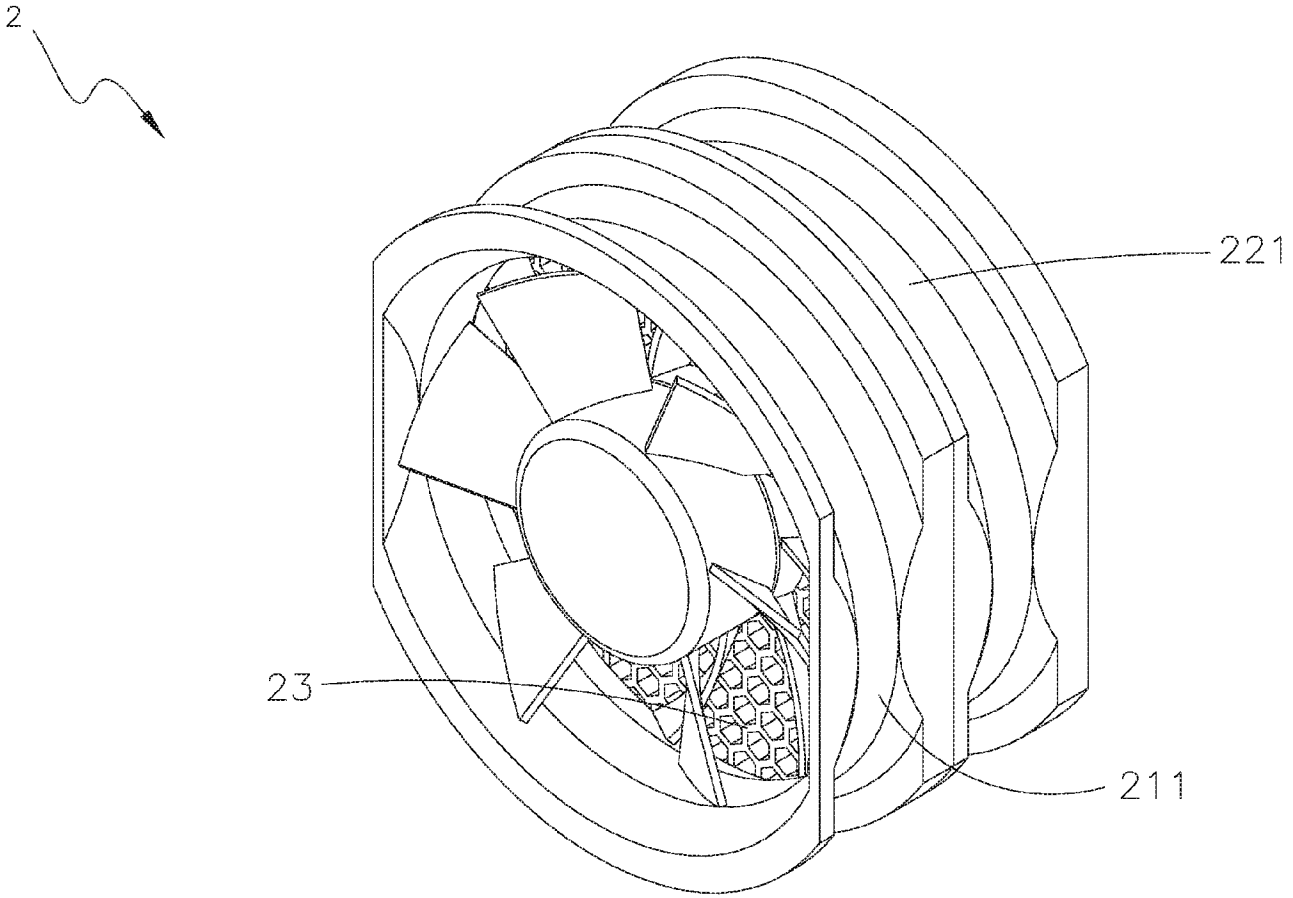
FIG. 3 is a perspective assembled view of the first embodiment of the series fan structure of the present invention.

Please refer to FIGS. 2 and 3. FIG. 2 is a perspective exploded view of a first embodiment of the series fan structure of the present invention. FIG. 3 is a perspective assembled view of the first embodiment of the series fan structure of the present invention. According to the first embodiment, the series fan structure 2 of the present invention includes a series fan assembly 21 and an assembling member 23. The series fan assembly 21 has a first fan 211 and a second fan 221. The first fan 211 is correspondingly serially connected with the second fan 221. The first fan 211 has a first fan frame 212, a first air inlet 2111 and a first air outlet 2112. The first air inlet 2111 and the first air outlet 2112 together define a first receiving space 213. A first dynamic impeller 215 is received in the first receiving space 213. The first dynamic impeller 215 has a first shaft 2151 and multiple first blades 2152. A first base seat 217 and first static blades 216 are disposed at the first air outlet 2112. One end of the first shaft 2151 is assembled with the first base seat 217.

The second fan 221 has a second fan frame 222, a second air inlet 2211 and a second air outlet 2212. The second air inlet 2211 and the second air outlet 2212 together define a second receiving space 223. A second dynamic impeller 225 is received in the second receiving space 223. The second dynamic impeller 225 has a second shaft 2251 and multiple second blades 2252. A second base seat 227 and second static blades 226 are disposed at the second air outlet 2212. One end of the second shaft 2251 is assembled with the second base seat 227.

The assembling member 23 is disposed between the first fan frame 212 and the second fan frame 222. The assembling member 23 is formed with multiple perpendicular or oblique perforations 231 in the form of straight-through passages in communication with the first and second receiving spaces 213, 223. The material of the assembling member 23 is selected from a group consisting of metal (aluminum, steel or other alloy), plastic, rubber and polymer material. In this embodiment, the assembling member 23 is, but not limited to, a wave guide plate. In practice, the assembling member 23 can be any other equivalent. The perforations 231 have, but not limited to, a hexagonal configuration. Alternatively, the perforations 231 can have a circular configuration, a triangular configuration, a rectangular configuration, a polygonal configuration or any other geometric configuration. The change of the configuration of the perforations 231 will not affect the effect achieved by the present invention.

Figure 4:
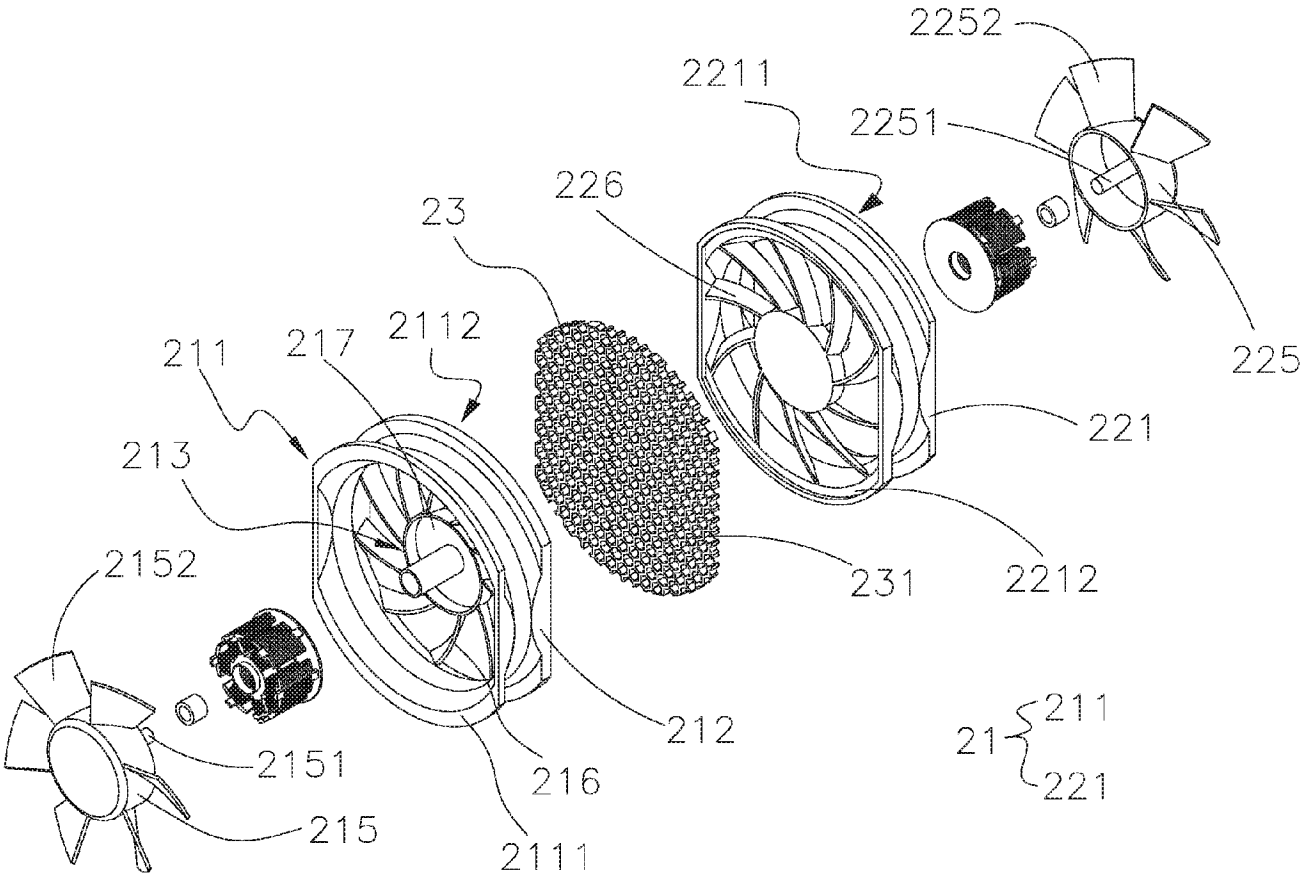
FIG. 4 is a perspective exploded view of a second embodiment of the series fan structure of the present invention.
Figure 5:
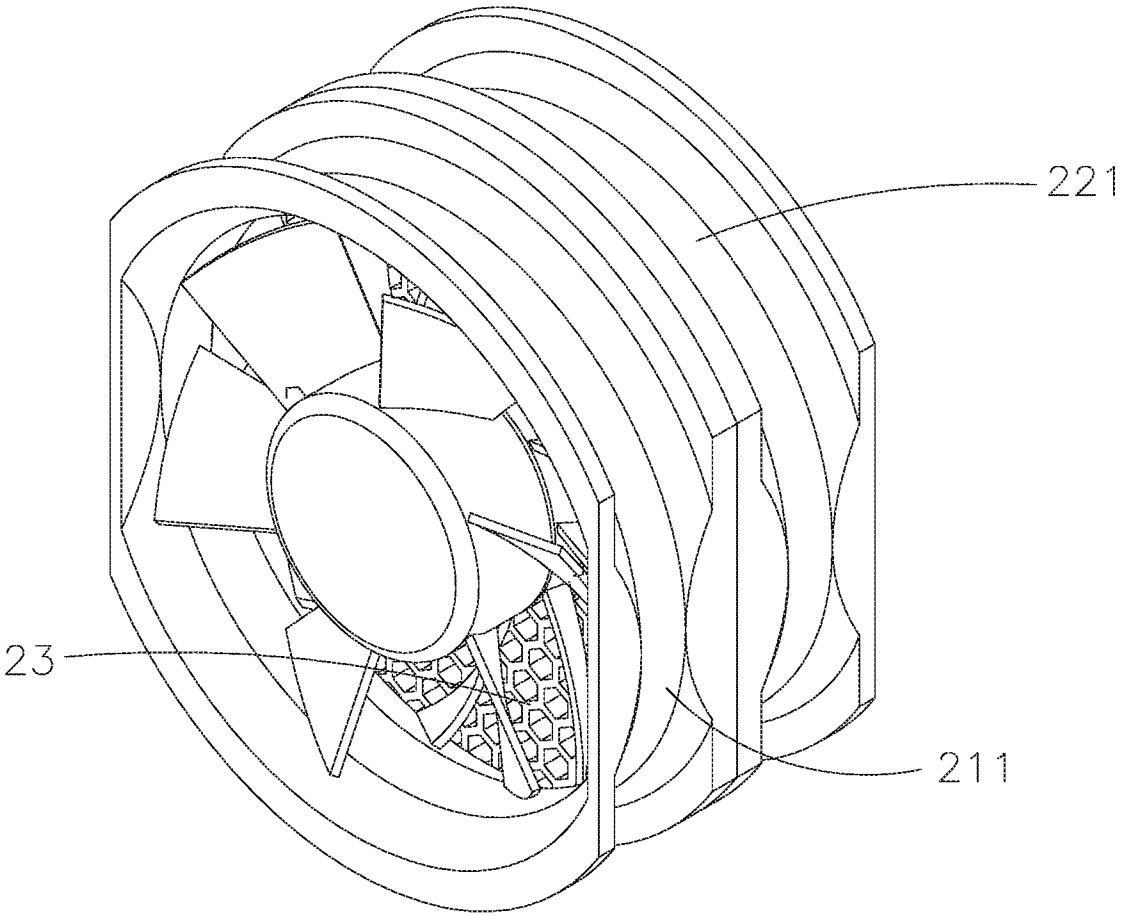
FIG. 5 is a perspective assembled view of the second embodiment of the series fan structure of the present invention.

In this embodiment, the assembling member 23 is, but not limited to, correspondingly disposed in a position between the first air outlet 2112 of the first fan 211 and the second air inlet 2211 of the second fan 221. In practice, as shown in FIGS. 4 and 5, the assembling member 23 can be alternatively correspondingly disposed in a position between the first air outlet 2112 of the first fan 211 and the second air outlet 2212 of the second fan 221. The effect of the present invention can be achieved by both serial connection manners.

Please further refer to FIGS. 2 and 3. According to the structural design of the present invention, the series fan assembly 21 and the assembling member 23 are assembled in such a manner that the assembling member 23 is inlaid in the first air outlet 2112 of the first fan 211 in flush with the first air outlet 2112. In other words, the assembling member 23 is inlaid and connected in the inner wall of the first fan frame 212 in flush with the first air outlet 2112. Then, the second fan 221 is serially securely connected with the first fan 211 to fix the assembling member 23 between the first and second fans 211, 221. It is known that when the conventional series fan structure operates, the fan frames of the two serially connected fans will co-vibrate to cause vibration problem. By means of the assembling member 23 of the present invention, the vibration problem of the conventional series fan structure is greatly improved. Also, the noise problem caused by the vibration is greatly reduced. Moreover, by means of the arrangement of the assembling member 23, the air volume taken in from the first air inlet 2111 is first rectified by the assembling member 23 and then discharged. Therefore, the airflow volume is increased.

Figure 6:
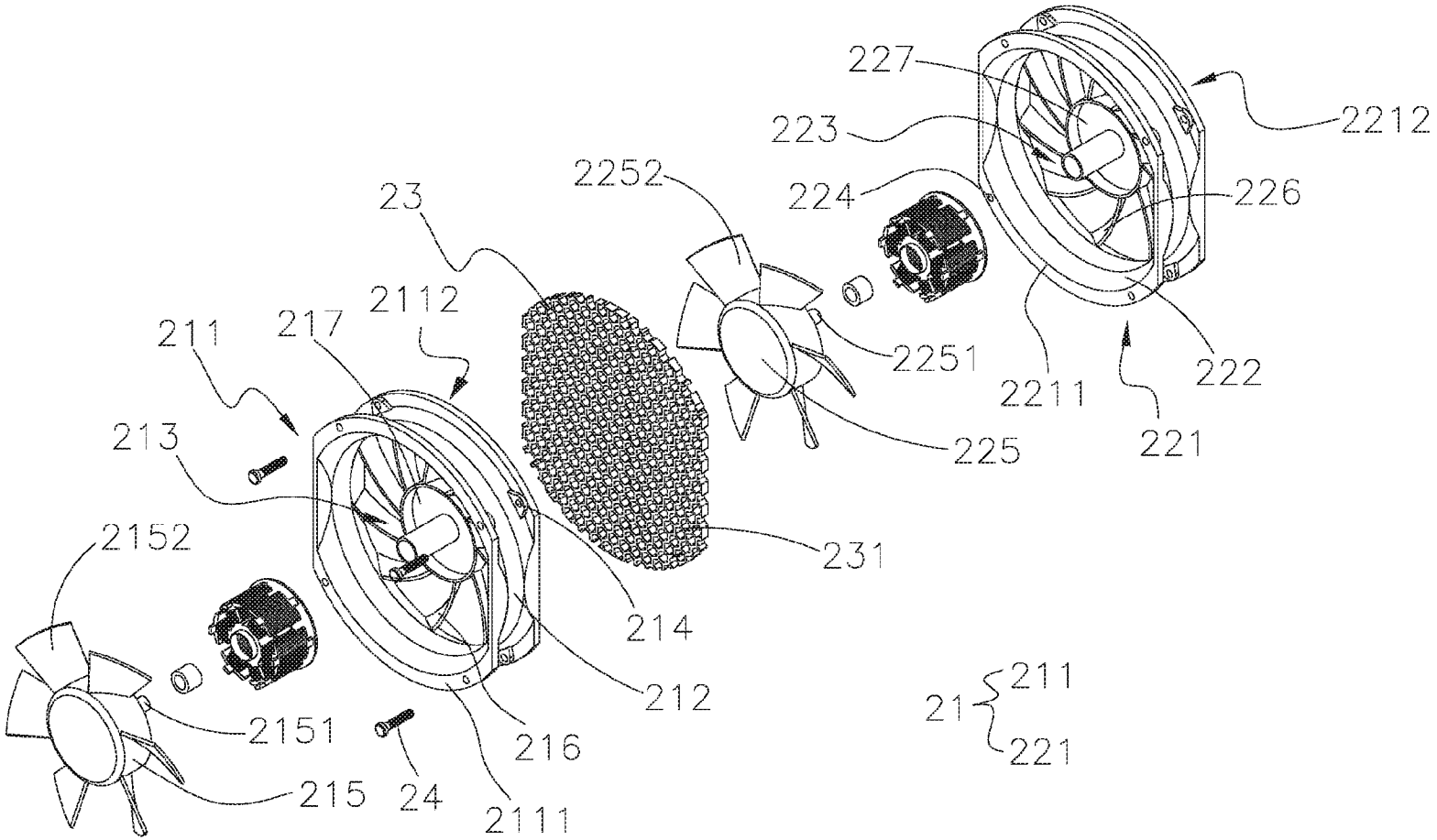
FIG. 6 is a perspective exploded view of a third embodiment of the series fan structure of the present invention.
Figure 7:
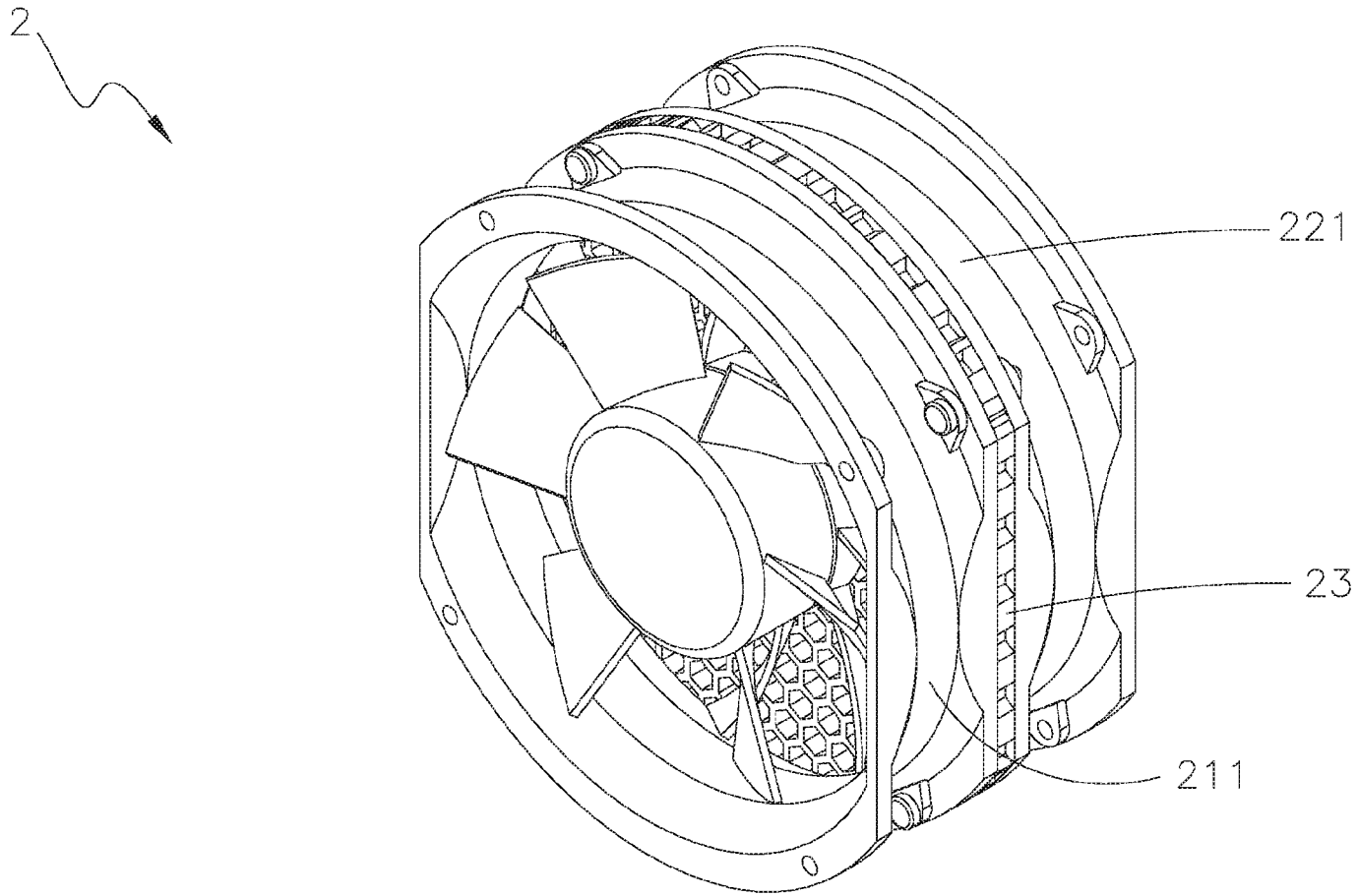
FIG. 7 is a perspective assembled view of the third embodiment of the series fan structure of the present invention.

Please now refer to FIGS. 6 and 7. FIG. 6 is a perspective exploded view of a third embodiment of the series fan structure of the present invention. FIG. 7 is a perspective assembled view of the third embodiment of the series fan structure of the present invention. The third embodiment is partially identical to the series fan structure 2 of the first embodiment in component and relationship between the components and thus will not be repeatedly described hereinafter. The third embodiment is mainly different from the first embodiment in that multiple raised assembling sections 214 are disposed on the periphery of the first fan frame 212. Multiple connection sections 224 are disposed on the periphery of the second fan frame 222 corresponding to the assembling sections 214. Multiple locking members 24 are passed through the assembling sections 214 and the connection sections 224 to assemble the assembling sections 214 and the connection sections 224 with each other. The locking members 24 are, but not limited to, screws. In practice, the locking members 24 can be any other equivalent (such as bolts or rivets). In this embodiment, the series fan assembly 21 and the assembling member 23 are, but not limited to, serially assembled with each other in a locking manner to form the series fan structure 2. In practice, the series fan assembly 21 and the assembling member 23 can be alternatively assembled with each other by means of adhesion, engagement, latching or any other equivalent to achieve the same effect.

In conclusion, in comparison with the conventional series fan structure, the present invention has the following advantages:

1. The present invention greatly improves the vibration problem of the conventional series fan structure.
2. The present invention greatly reduces the noise problem of the conventional series fan structure due to vibration.
3. The present invention is able to increase airflow volume.

The present invention has been described with the above embodiments thereof and it is understood that many changes and modifications in such as the form or layout pattern or practicing step of the above embodiments can be carried out without departing from the scope and the spirit of the invention that is intended to be limited only by the appended claims.

What is claimed is:

1. A series fan structure comprising:

a series fan assembly having a first fan and a second fan serially connected with the first fan, the first fan having a first fan frame defining a first receiving space, a first dynamic impeller being received in the first receiving space, the second fan having a second fan frame defining a second receiving space, a second dynamic impeller being received in the second receiving space; and an assembling member disposed between the first fan frame and the second fan frame and inlaid and connected in an inner wall of the first fan frame, the assembling member being formed with multiple straight-through perforations in communication with the first and second receiving spaces.

2. The series fan structure as claimed in claim 1, wherein the first fan has a first air inlet and a first air outlet, the first air inlet and first air outlet communicating with the first receiving space, the second fan having a second air inlet and a second air outlet, the second air inlet and second air outlet communicating with the second receiving space.

3. The series fan structure as claimed in claim 2, wherein the assembling member is correspondingly disposed between the first air outlet and the second air inlet.

4. The series fan structure as claimed in claim 2, wherein a first base seat and first static blades are disposed at the first air outlet, a second base seat and second static blades being disposed at the second air outlet.

5. The series fan structure as claimed in claim 4, wherein the first dynamic impeller has a first shaft and multiple first blades, one end of the first shaft being assembled with the first base seat, the second dynamic impeller having a second shaft and multiple second blades, one end of the second shaft being assembled with the second base seat.

6. The series fan structure as claimed in claim 1, wherein the assembling member is a wave guide plate.

7. The series fan structure as claimed in claim 1, wherein the perforations have a circular configuration, a hexagonal configuration or any other geometric configuration.

8. The series fan structure as claimed in claim 1, wherein the series fan assembly and the assembling member are assembled with each other by means of insertion, locking, adhesion, engagement or latching.

9. The series fan structure as claimed in claim 1, wherein the perforations of the assembling member are perpendicular or oblique perforations in the form of straight-through passages.

10. The series fan structure of claim 4, wherein the first base seat is arranged adjacent the assembling member and the second base seat is arranged distal the assembling member with the second dynamic impeller interposed between the second base seat and the assembling member.

* * * * *